US009267315B2

(12) United States Patent
Lee

(10) Patent No.: US 9,267,315 B2
(45) Date of Patent: Feb. 23, 2016

(54) DOOR SAFETY LOCKING APPARATUS

(71) Applicant: Poong Won Industry Co., LTD., Gimhae, Kyungnam (KR)

(72) Inventor: June Young Lee, Gimhae (KR)

(73) Assignee: Poong Won Industry Co., Ltd. (KR)

( * ) Notice: Subject to any disclaimer, the term of this patent is extended or adjusted under 35 U.S.C. 154(b) by 220 days.

(21) Appl. No.: 13/845,249

(22) Filed: Mar. 18, 2013

(65) Prior Publication Data

US 2014/0265378 A1 Sep. 18, 2014

(51) Int. Cl.

| | |
|---|---|
| ***E05C 3/06*** | (2006.01) |
| ***E05C 19/02*** | (2006.01) |
| ***D06F 39/14*** | (2006.01) |
| ***E05B 47/06*** | (2006.01) |
| ***E05B 65/00*** | (2006.01) |
| ***E05B 47/00*** | (2006.01) |
| ***A47L 15/42*** | (2006.01) |
| *E05B 15/02* | (2006.01) |

(52) U.S. Cl.

CPC ..... *E05C 19/024* (2013.01); *A47L 15/4259* (2013.01); *D06F 39/14* (2013.01); *E05B 47/0004* (2013.01); *E05B 47/0603* (2013.01); *E05B 65/0046* (2013.01); *E05B 65/0053* (2013.01); *Y10T 292/702* (2015.04)

(58) Field of Classification Search

CPC ..... E05C 3/004; E05C 2005/005; E05B 47/0001; E05B 47/06; E05B 47/0603; E05B 2047/0073; E05B 65/0042; E05B 65/0046

USPC ..... 292/56, 70, 71, 78, 63, 64, 67–69, 198, 292/DIG. 71, 109, 110, 121, 128, 129, 99, 292/101–103, 240–242, 201, 216, DIG. 69, 292/341.15–341.17; 134/57 DL, 58 DL

See application file for complete search history.

(56) References Cited

U.S. PATENT DOCUMENTS

| | | | | | |
|---|---|---|---|---|---|
| 1,199,199 | A | * | 9/1916 | Mason | 292/201 |
| 1,872,092 | A | * | 8/1932 | Neverman | 70/159 |
| 2,469,283 | A | * | 5/1949 | Steele | 292/201 |
| 2,554,442 | A | * | 5/1951 | Ehret | 292/78 |
| 2,601,983 | A | * | 7/1952 | Schoelkopf | 49/276 |
| 2,683,052 | A | * | 7/1954 | Lang | 292/220 |

(Continued)

FOREIGN PATENT DOCUMENTS

| | | | | |
|---|---|---|---|---|
| FR | 2093206 | A5 | * | 1/1972 |
| KR | 10-2005-0066293 | A | | 6/2005 |
| WO | WO 9428276 | A1 | * | 12/1994 |

*Primary Examiner* — Alyson M Merlino

(74) *Attorney, Agent, or Firm* — Park & Associates IP Law, P.C.

(57) ABSTRACT

A door safety locking apparatus door safety locking apparatus including: a body mounted inside a housing; a locker mounted inside a door opening and closing the interior of the housing in such a manner as to be separably fitted to the body; a dog coupled to the interior of the body by means of a shaft and having a locking protrusion formed on the upper end thereof to lock a coupling hole pierced on the locker thereonto; a tilting rod coupled at the front end thereof to the dog by means of a pin and coupled at the end portion thereof to the bottom surface of the interior of the body by means of a hinge, to guide the dog being rotated around the shaft in accordance with the pulling operation of the locker; and a spring fitted around the outer periphery of the tilting rod to elastically support the tilting rod guiding the rotating operation of the dog.

2 Claims, 5 Drawing Sheets

(56) References Cited

U.S. PATENT DOCUMENTS

| | | | | | |
|---|---|---|---|---|---|
| 2,833,578 | A | * | 5/1958 | Burke | 292/71 |
| 2,910,859 | A | * | 11/1959 | Allen et al. | 70/135 |
| 3,506,292 | A | * | 4/1970 | Hagendoorn et al. | 292/78 |
| 3,659,886 | A | * | 5/1972 | Andrews | 292/78 |
| 4,088,354 | A | * | 5/1978 | Kolendowicz | 292/201 |
| 4,210,349 | A | * | 7/1980 | Cook et al. | 292/78 |
| 2005/0257813 | A1 | * | 11/2005 | Shin | 134/56 D |
| 2006/0097522 | A1 | * | 5/2006 | Denison et al. | 292/201 |
| 2011/0254292 | A1 | * | 10/2011 | Ishii | 292/341.15 |

* cited by examiner

DOOR SAFETY LOCKING APPARATUS

FIELD OF THE INVENTION

The present invention relates to a door safety locking apparatus, and more particularly, to a door safety locking apparatus that allows a locked state of a door to be automatically released if a given pressure is applied from the interior of the door in a mechanical way, thereby preventing safety accidents from happening.

BACKGROUND OF THE INVENTION

Generally, a door is provided to all kinds of electronic products such as refrigerators, washing machines and the like, and thus, the door is rotated around a hinge shaft to open and close the interior of the electronic product.

On the other hand, the door of the electronic product has a separate locking apparatus for preventing the door from being arbitrarily open while the electronic product is being operated.

One example of such conventional door locking apparatuses has been disclosed in Korean Patent Application Laid-Open No. 10-2005-0066293 (entitled 'door safety apparatus for washing machine), wherein the door safety apparatus includes a washing machine door, a pressing protrusion formed on the inner periphery of the door in such a manner as to be detachable from the door, and a sensing switch adapted to be pressed by means of the pressing protrusion, if the door is closed, to sense the closing of the door, so that if the sensing switch is pressed by means of the pressing protrusion, the pressing protrusion is brought into contact with the contact point provided in the interior of the sensing switch, thereby sensing the closing of the door.

According to the above-mentioned prior art, even though the door is closed in the situation where a child or animal is locked in the washing machine, the washing machine is not operated to previously prevent safety accidents like asphyxial deaths from happening.

Since the above-mentioned prior art senses the door closing in an electrical way, however, malfunctions of the electrical product frequently occur to cause the reliability of the product to be deteriorated.

SUMMARY OF THE INVENTION

Accordingly, the present invention has been made in view of the above-mentioned problems occurring in the prior art, and it is an object of the present invention to provide a door safety locking apparatus that allows a locked state of a door to be automatically released just by pushing the door outwardly even if a child is locked in an electronic product by means of door closing, thereby previously preventing various safety accidents from happening.

To accomplish the above object, according to the present invention, there is provided a door safety locking apparatus including: a body mounted inside a housing; a locker mounted inside a door opening and closing the interior of the housing in such a manner as to be separably fitted to the body; a dog coupled to the interior of the body by means of a shaft and having a locking protrusion formed on the upper end thereof to lock a coupling hole pierced on the locker thereonto; a tilting rod coupled at the front end thereof to the dog by means of a pin and coupled at the end portion thereof to the bottom surface of the interior of the body by means of a hinge, to guide the dog being rotated around the shaft in accordance with the pulling operation of the locker; and a spring fitted around the outer periphery of the tilting rod to elastically support the tilting rod guiding the rotating operation of the dog.

According to the present invention, preferably, the body further has a stopper pin adapted to be inserted into a solenoid actuator mounted thereon in such a manner as to be drawn therefrom to restrict the rotation of the dog in accordance with the operation of the solenoid actuator.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE INVENTION

Hereinafter, an explanation on a door safety locking apparatus according to the present invention will be in detail given with reference to the attached drawings.

In the following description, a preferred embodiment of the present invention will be given to accomplish the technical subjects as mentioned above, and other preferred embodiments of the present invention will be replaced with the configuration of the present invention.

According to the present invention, a door safety locking apparatus is configured to allow the locked state of a door to be automatically released just by pushing the door outwardly, in a state of being mounted at the inside of the door, so that if a child is locked in an electronic product by means of door closing, he just pushes the door outwardly to open, thereby preventing various safety accidents from happening.

Figure 1:
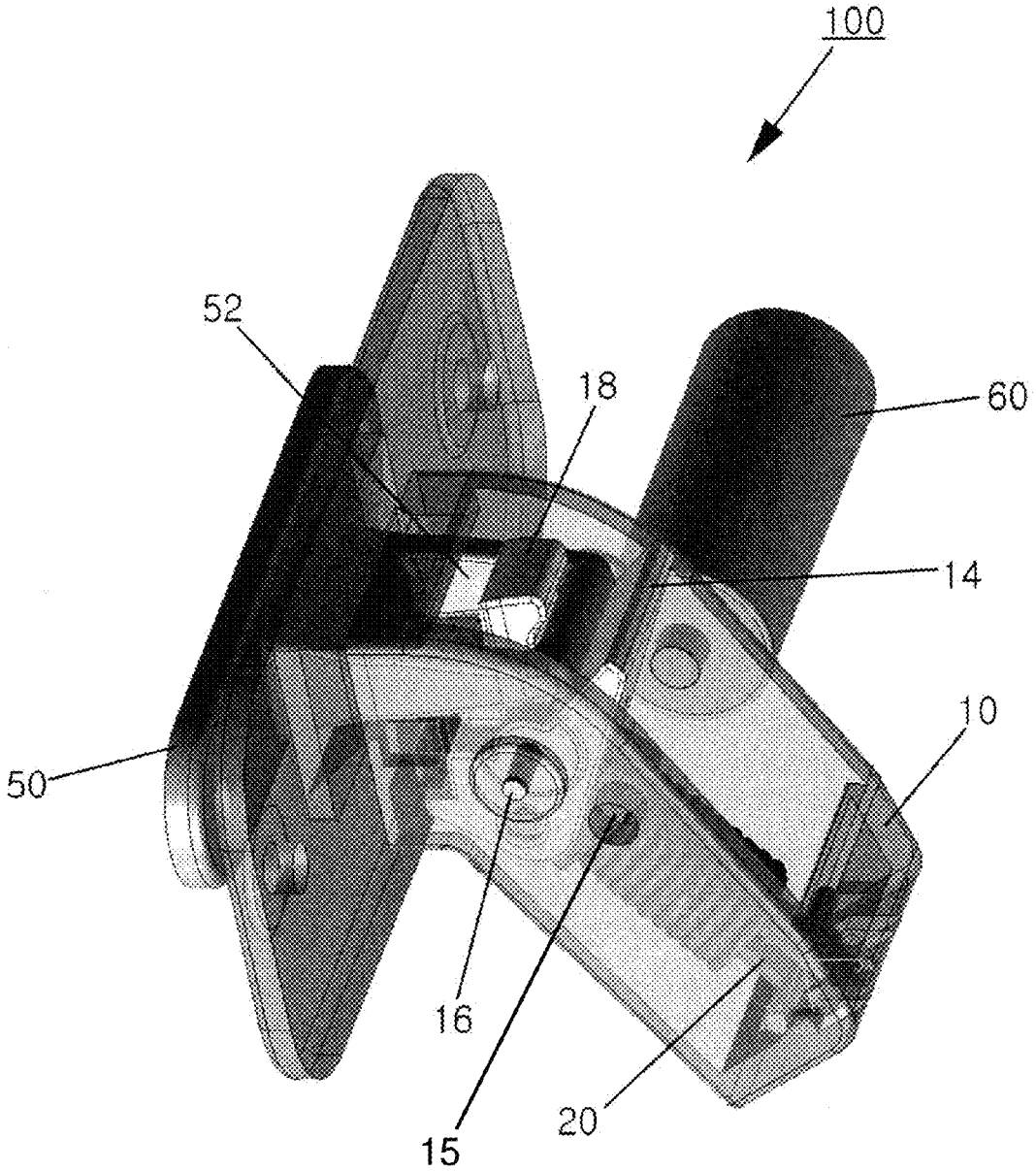
FIG. 1 is a three-dimensional view showing the locking state between a body and a locker of a door safety locking apparatus according to the present invention.
Figure 2:
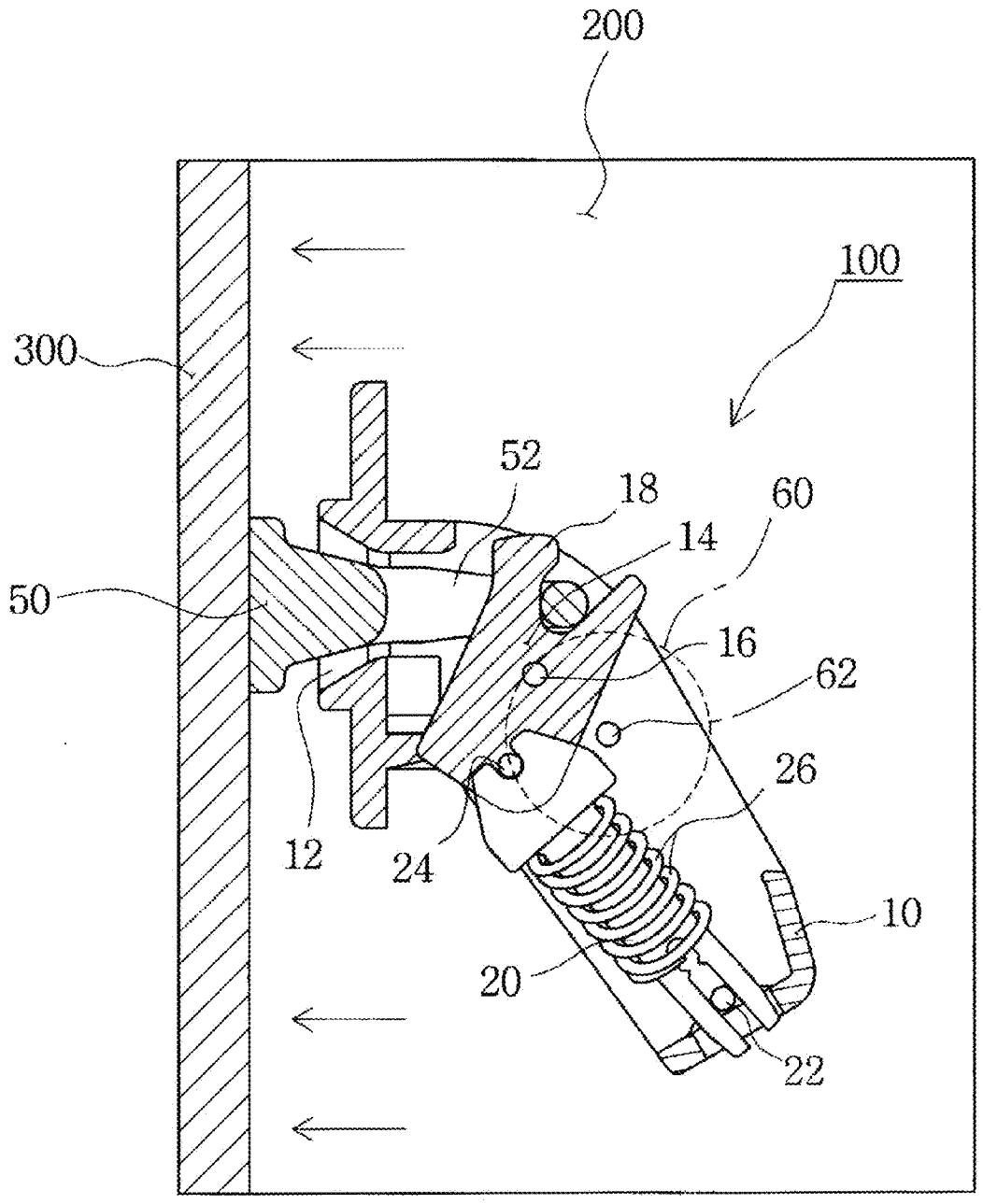
FIG. 2 is a sectional view of FIG. 1.
Figure 3:
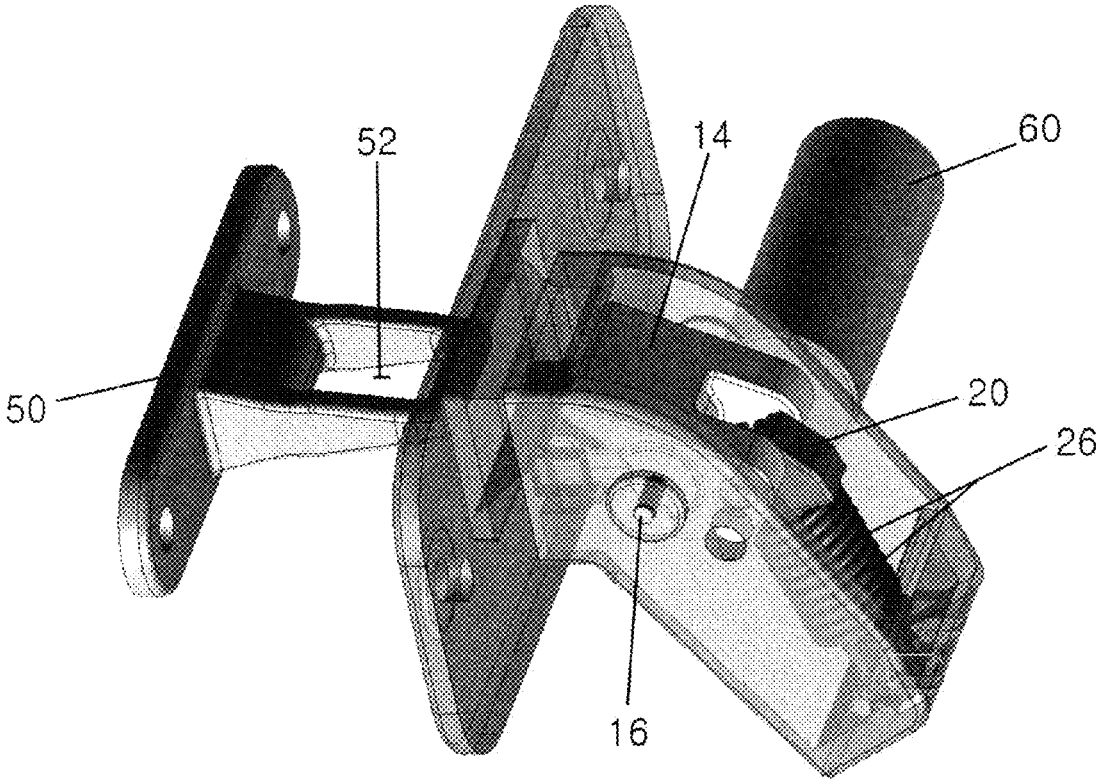
FIG. 3 is a three-dimensional view showing the unlocking state between the body and the locker of the door safety locking apparatus according to the present invention.
Figure 4:
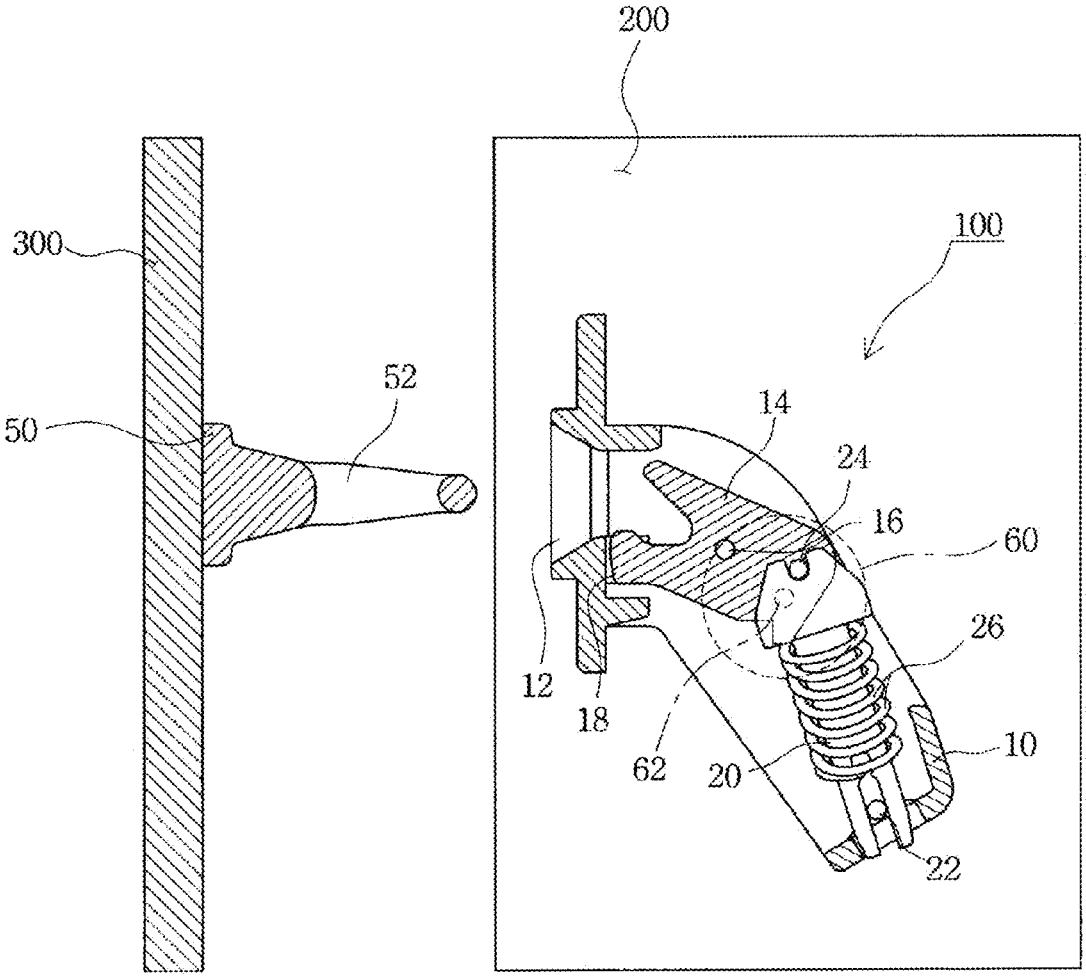
FIG. 4 is a sectional view of FIG. 3.

FIGS. 1 and 2 show the locking structure between a body and a locker constituting a door safety locking apparatus according to the present invention, and FIGS. 3 and 4 show the unlocking state between the body and the locker of the door safety locking apparatus according to the present invention.

As shown in FIGS. 1 to 4, a door safety locking apparatus 100 according to the present invention largely includes a body 10 mounted inside a housing 200 constituting the outer shape of an electronic product like a washing machine, a refrigerator, and so on and a locker 50 mounted on a door 300 opening and closing the internal space of the housing 200.

The body 10, which constitutes the outer shape of the door safety locking apparatus 100, is empty in the interior thereof and has an insertion hole 12 penetrated into the front surface thereof to insert the locker 50 thereinto.

A dog 14 is coupled to the interior of the body 10 by means of a shaft 16. The dog 14 has the upper end having a locking protrusion 18 formed to lock a coupling hole 52 of the locker 50 thereonto and the lower end coupled to the front end of a tilting rod 20 as will be described later by means of a pin 24. As the locker 50 is pushed outwardly to pull the locking protrusion 18, the dog 14 is rotated around the shaft 16 to allow the locked state of the locker 50 onto the locking protrusion 18 to be released.

The body 10 further includes the tilting rod 20 mounted at the inside thereof. The tilting rod 20 is coupled at the end portion thereof to the bottom surface of the interior of the body 10 by means of a hinge 22 and coupled at the front end thereof to the lower end of the dog 14 by means of the pin 24, so that during the rotation of the dog 14, the tilting rod 20 is tiltedly operated around the hinge 22, thereby guiding the rotating operation of the dog 14.

The tilting rod 20 has a spring 26 fitted around the outer periphery thereof. The spring 26 serves to elastically support the tilting rod 20 being tiltedly operated around the hinge 22 to guide the rotating operation of the dog 14.

The locker 50 is adapted to be inserted into the insertion hole 12 of the body 10 in accordance with the closing operation of the door 300, in the state of being mounted at the inside of the door 300. The locker 50 has the coupling hole 52 penetrated thereinto. The coupling hole 52 is locked to the locking protrusion 18 of the dog 14 if the locker 50 is fitted to the insertion hole 12 of the body 10, thereby coupledly fitting the locker 50 to the body 10 to lock the door 100.

Figure 5:
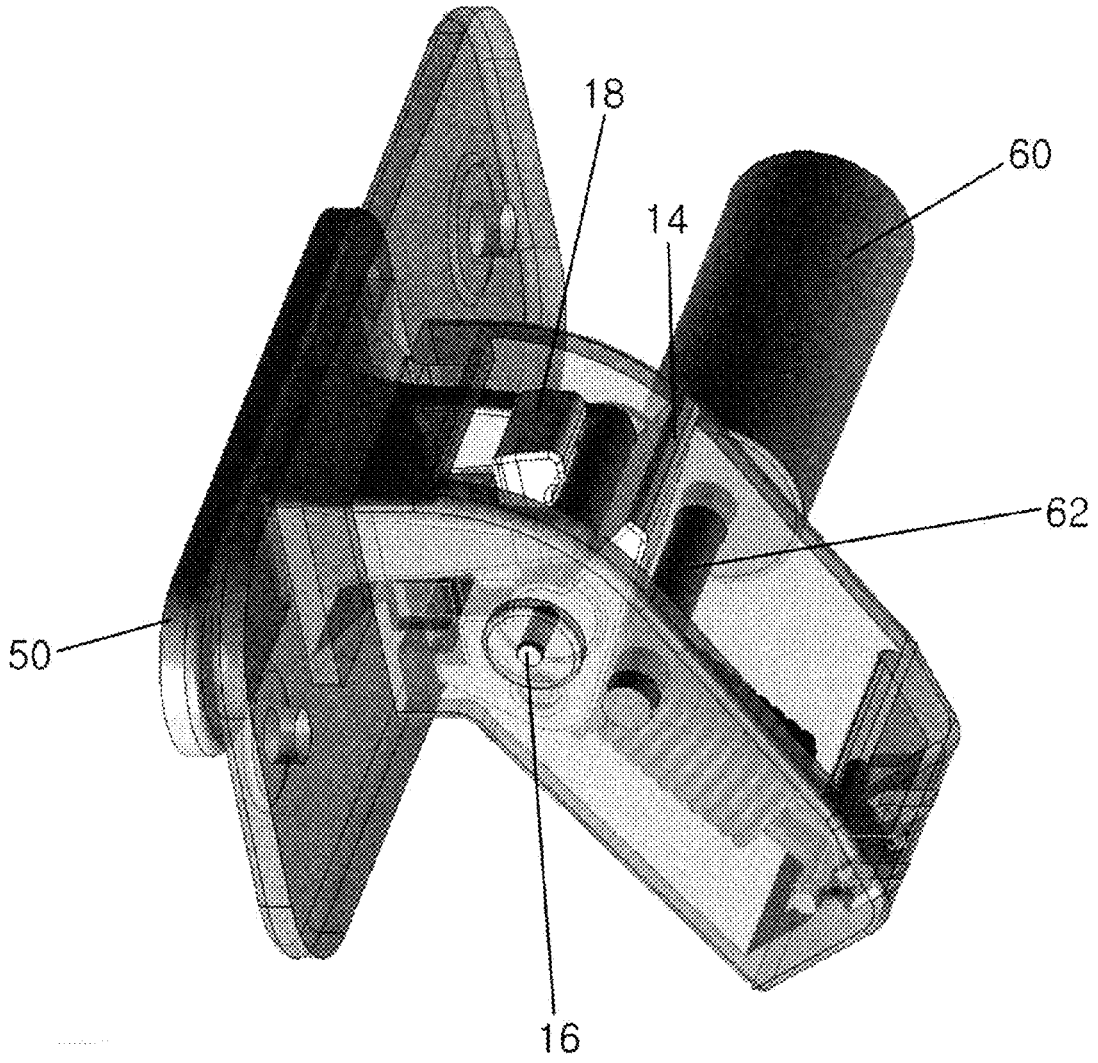
FIG. 5 is a three-dimensional view showing the state where a stopper pin is drawn by means of the operation of a solenoid actuator in the door safety locking apparatus according to the present invention.

On the other hand, as shown in FIG. 5, a solenoid actuator 60 is mounted on the body 10 and has a stopper pin 62 adapted to be inserted thereinto in such a manner as to be drawn therefrom. The stopper pin 62 is drawn to penetrate the body 10 for coupling to an engagement structure (e.g., insertion opening 15) by means of the electrical operation of the solenoid actuator 60 and restricts the rotation of the dog 14 to prevent the door 100 from being released from the locking state. In normal cases, the stopper pin 62 is drawn from the solenoid actuator 60 in the state of being inserted thereinto in accordance with a user's demand, thereby restricting the rotation of the dog 14.

Hereinafter, an explanation on the operating state of the door safety locking apparatus according to the present invention will be in detail given with reference to FIGS. 1 to 4.

If the closing operation of the door 300 is performed, as shown in FIGS. 1 and 2, the locker 50 is first inserted into the insertion hole 12 of the body 10, and accordingly, the coupling hole 52 formed on the locker 50 is locked onto the locking protrusion 18 of the dog 14 to allow the locker 50 to be fixedly coupled to the body 10, thereby finishing the locked state of the door 300.

On the other hand, as shown in FIGS. 3 and 4, if the door 300 is closed in the state where a child is locked in the housing 200 due to his carelessness, the door 300 is just pushed outwardly by him, so that the locker 50 mounted inside the door 300 is pushed outwardly to pull the locking protrusion 18 of the dog 14, and accordingly, the dog 14 is rotated around the shaft 16 to allow the locked state of the locker 50 onto the locking protrusion 18 to be released. Thus, the locked state of the door 300 is automatically released to open the door 300.

Under the user's demand, further, if it is desired to prevent the releasing state of the door 300 in the case where the door 300 is pushed outwardly, as shown in FIG. 5, electric current is sent to the solenoid actuator 60 and the stopper pin 62 is exposed to the outside. Accordingly, the stopper pin 62 is penetrated into the body 10 and supports the dog 14 being rotated in the state of being located behind the door 14, thereby restricting the rotation of the dog 14, and thus, the locking state of the locker 50 onto the locking protrusion 18 of the dog 14 is not released, thereby preventing the locked state of the door 300 from being released.

As set forth in the foregoing, the door safety locking apparatus according to the present invention is configured to allow the locked state of the door to be automatically released just by pushing the door outwardly, so that if a child is locked in an electronic product by means of door closing, he just pushes the door outwardly to open, thereby previously preventing various safety accidents from happening.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A door safety locking apparatus for operably holding a door with respect to a housing structure, the apparatus comprising: a body mounted to the housing structure; a locker mounted to the door, the locker having an elongated shape with a coupling hole formed at a distal portion of the locker; a dog coupled to the body by means of a pivot shaft and having a locking protrusion formed at an upper portion thereof to engage the coupling hole of the locker to place the door in a locked state; a tilting rod having a front end portion operably coupled to a lower portion of the dog by means of a pin, and a rear end portion coupled to the body by means of a hinge, wherein the tilting rod guides rotation of the dog about the pivot shaft in response to a pulling operation of the locker; a spring fitted to the tilting rod to elastically support the tilting rod and guide the rotation of the dog; and a solenoid actuator mounted to the body and having a stopper pin reciprocally moveable relative to the solenoid actuator in a direction perpendicular to the body, wherein the body includes an engagement structure which is configured such that a distal end of the stopper pin is coupled thereto when the stopper pin is moved toward the engagement structure in response to an operation of the solenoid actuator, wherein the stopper pin blocks the dog from rotating when the distal end of the stopper pin is coupled to the engagement structure and thereby prevents the door from being released from the locked state, wherein the body includes a pair of parallel walls, wherein the dog, the tilting rod, and the spring are installed in the body between the parallel walls, wherein the solenoid actuator is positioned outside of one of the parallel walls, and the engagement structure is formed at the other one of the parallel walls such that when the distal end of the stopper pin is coupled to the engagement structure, the stopper pin extends between the parallel walls, blocking the rotation of the dog.

2. The door safety locking apparatus of claim 1, wherein the engagement structure is in form of an insertion opening.

* * * * *